US006945824B1

(12) United States Patent
Li et al.

(10) Patent No.: US 6,945,824 B1
(45) Date of Patent: Sep. 20, 2005

(54) CONNECTOR ASSEMBLY

(75) Inventors: Yu Li, Dong-Guan (CN); Gaohua Du, Dong-Guan (CN); Li Jun Xu, Dong-Guan (CN)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/923,894

(22) Filed: Aug. 24, 2004

(51) Int. Cl.[7] ..... H01R 33/00
(52) U.S. Cl. ..... 439/660
(58) Field of Search ..... 439/660, 76.1, 439/79, 700, 289, 607, 101, 108

(56) References Cited

U.S. PATENT DOCUMENTS 6,165,016 A * 12/2000 Lai ..... 439/610
6,296,521 B1 * 10/2001 Chang et al. ..... 439/607
6,309,255 B1 * 10/2001 Yu ..... 439/660
6,371,771 B1 * 4/2002 Fan ..... 439/79
6,383,023 B1 * 5/2002 Chang et al. ..... 439/607
6,413,112 B2 * 7/2002 Semmeling et al. ..... 439/358
6,435,912 B1 * 8/2002 Zhu et al. ..... 439/607
6,524,140 B2 * 2/2003 Takagi et al. ..... 439/700
6,685,508 B2 * 2/2004 Zhu et al. ..... 439/607

* cited by examiner

*Primary Examiner*—Alexander Gilman
(74) *Attorney, Agent, or Firm*—Rosenberg, Klein & Lee

(57) ABSTRACT

The present invention provides a connector assembly, which includes a USB (Universal Serial Bus) plug and a USB receptacle. The plug and receptacle both have a plurality of first contacts and second contacts. The first contacts include a pair of power contacts and a pair of signal contacts, and the second contacts are composed of a pair of new signal contacts. When the plug mates with the receptacle, the first and the second contacts of the plug and receptacle connect electrically with each other correspondingly whereby the connector assembly of the present invention has a more powerful signal transmission function.

8 Claims, 4 Drawing Sheets

CONNECTOR ASSEMBLY

BACKGROUND OF THE INVENTION

1. Field of the Invention

The present invention relates generally to a connector assembly, and more especially to a USB (Universal Serial Bus) connector assembly.

2. The Related Art

As we know, since the USB connector has many features, such as "Plug and Play", "hot-swapping", and a high signal transmission speed etc., it has an extensive application field, especially in the computer and peripherals field.

In general, a USB connector assembly includes a plug and a receptacle adapted to mate each other. Both the conventional plug and receptacle receive a pair of power terminals and a pair of signal terminals therein. As using, the power and signal terminals of the plug and receptacle connect electrically correspondingly, thereby the power and the signal could be transferred therebetween.

At present, following with users constantly ask high requirement to enhance the computer and peripherals products function, the trend of various electronic apparatuses, such as the note book computer, the mobile phone or the digital still camera etc., is to constantly integrate various functions. In view of this, a corresponding high demand is brought up about both a signal transmission speed and a signal transmission type on the traditional USB connector. However, because of a limit of the standard USB structure and the restricted terminal number, the conventional USB connector as described above could only transmit one type signal and not completely realize the signal transmission function. Thereby, it is urgent to design a new type connector in the base of the standard USB structure, which is capable of providing a more powerful signal transmission function.

SUMMARY OF THE INVENTION

Thus, an object of the present invention is to provide a plug, which is designed so as to provide a more powerful signal transmission function when the plug mates with a receptacle.

Another object of the present invention is to provide a connector assembly, which is capable of realizing a more powerful signal transmission function.

To attain one object as mentioned above, the present invention provides a plug, which includes a plug housing enclosed within a plug shell. The plug housing has a base body with a protruding body extending upwardly from the substantial middle part of the base body. The base body is lengthwise defined with a plurality of first plug contact grooves on the top surface thereof. The first plug contact grooves pass through a lower surface of the protruding body and receive a plurality of first plug contacts therein. The first plug contacts are composed of a pair of juxtaposed power contacts and a pair of juxtaposed signal contacts. Each first plug contact has a first base portion. The first base portion of the first plug contact is provided with a first soldering portion extending rearwards therefrom for being soldered with a cable and a first engaging portion extending forwards therefrom for connecting electrically with a mated receptacle. The base body of the plug housing further is defined with a plurality of second plug contact grooves below the first plug contact grooves. The second plug contact grooves pass through the base body and receive a plurality of second plug contacts therein. The second plug contacts are composed of a pair of juxtaposed signal contacts. Each second plug contact has a second base portion. The second base portion of the second plug contact is shaped with a second soldering portion extending rearwards therefrom for being soldered with the cable and a second engaging portion extending upwards therefrom for connecting electrically with the mated receptacle. The second engaging portion is formed with a front holding portion extending rearwards from a free end thereof for holding the second plug contact in the plug housing.

To attain another object as mentioned above, the present invention provides a connector assembly, which comprises the plug as described above and a receptacle adapted for mating with the plug. The receptacle has a receptacle housing enclosed within a receptacle shell. The receptacle housing has a main body with a cantilever body extending forwardly from the main body. The main body is lengthwise defined with a plurality of first receptacle contact grooves for receiving a plurality of first receptacle contacts therein. The first receptacle contact grooves pass through the main body and extend forwardly to reach a front end of the cantilever body along a lower surface of the cantilever body. The first receptacle contacts are also composed of a pair of juxtaposed power contacts and a pair of juxtaposed signal contacts. Each first receptacle contact has a first main portion. The first main portion of the first receptacle contact is shaped with a first through-hole portion extending downwardly therefrom for connecting electrically with a PCB and a first conductive portion extending forwardly therefrom for connecting electrically with the mated plug. The main body of the receptacle housing further is lengthwise defined with a plurality of second receptacle contact grooves below the first receptacle grooves. The second receptacle contact grooves pass through the main body and receive a plurality of second receptacle contacts therein. The second receptacle contacts are also composed of a pair of juxtaposed signal contacts. Each second receptacle contact has a second main portion. The second main portion of the second receptacle contact is formed with a second through-hole portion extending downwardly from the rear end thereof for connecting electrically with the PCB and a second conductive portion extending transversely from the front end thereof for connecting electrically with the mated plug. The pair of second conductive portions are arranged opposite to each other and each has a curve conductive area extending forwardly therefrom.

As mentioned above, while the plug and the receptacle mate each other, the first engaging portions of the first plug contacts connect electrically correspondingly with the first conductive portions of the first receptacle contacts, and the second engaging portions of the second plug contacts connect electrically correspondingly with the second conductive portions of the second receptacle contacts. As a result, the cable and the PCB are connected electrically, further the power and at least two types of signals are capable of being transmitted therebetween. Thus, the connector assembly of the present invention is capable of providing a more powerful signal transmission function by means of a new design of the added second signal contacts as described above.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 5:
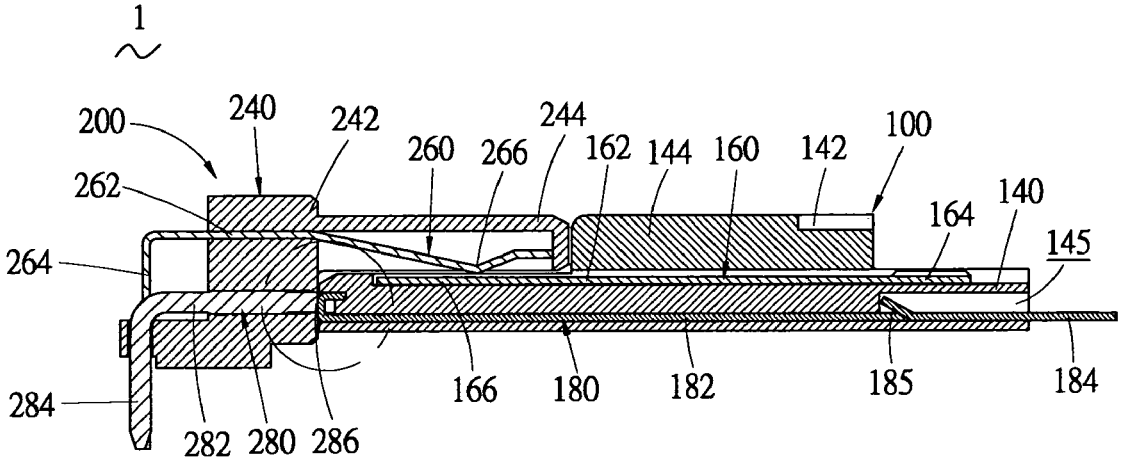
FIG. 5 is a sectional view of the connector assembly in accordance with the present invention.

A connector assembly in accordance with the present invention is generally denoted by reference numeral 1 as shown in FIG. 5. With first reference to FIGS. 1 and 2, the connector assembly 1 comprises a plug 100 and a receptacle 200 adapted to mate each other.

Figure 1:
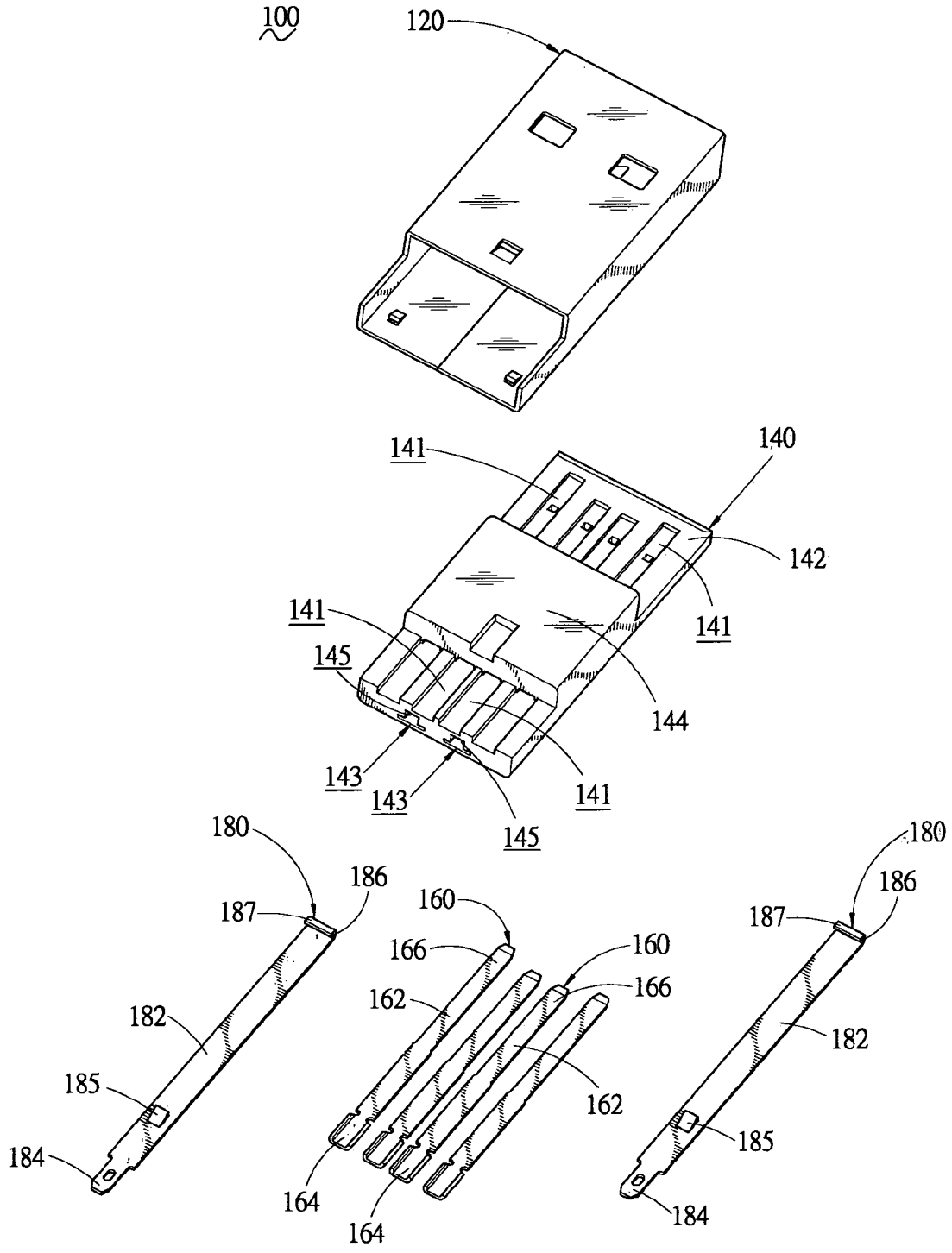
FIG. 1 is an exploded perspective view of a plug utilized in a connector assembly in accordance with the present invention.

As shown in FIG. 1, the plug 100 includes a plug housing 140 enclosed within a plug shell 120. The plug housing 140 receives a plurality of first plug contacts 160 and second plug contacts 180 therein.

The plug housing 140 has a base body 142 with a protruding body 144 extending upwardly from the substantial middle part thereof. The base body 142 is lengthwise defined with a plurality of first plug contact grooves 141 on the top surface thereof for receiving the first plug contacts 160 therein. Each first plug contact groove 141 passes through a lower surface of the protruding body 144, with one end thereof extending rearwards through the base body 142, and the other end thereof extending forwardly to reach a front end of the base body 142. Together with referring to FIGS. 5 and 6, the base body 142 is further defined with a plurality of second plug contact grooves 143 below the first plug contact grooves 141 for receiving the second plug contacts 180 therein. The second plug contact grooves 143 substantial parallel with the first plug contact grooves 141 and pass through the interior of the base body 142. Each of the second plug contact grooves 143 is formed with a rear holding groove 145 which has a narrower width than the second plug contact groove 143 extending upwardly a certain distance from the rear end thereof, and a front contact groove 147 extending upwardly a certain distance from the frond end thereof. Further, the front contact groove 147 is formed with a front holding groove 149 extending rearwards a certain distance therefrom and parallel with the second plug contact groove 143.

The first plug contacts 160 are composed of a pair of juxtaposed long power contacts and a pair of juxtaposed short signal contacts. Each first plug contact 160 has a first base portion 162. The first base portion 162 is provided with a first soldering portion 164 extending rearwards therefrom and a first engaging portion 166 extending forwardly therefrom.

The second plug contacts 180 are composed of a pair of juxtaposed signal contacts. Each second plug contact 180 has a second base portion 182. The second base portion 182 is shaped with a second soldering portion 184 extending rearwards therefrom and a second engaging portion 186 extending upwards therefrom, wherein the second engaging portion 186 is formed with a front holding portion 187 extending rearwards from a free end thereof. Moreover, approached the second soldering portion 184, the second base portion 182 is cut and bent to form a rear holding portion 185 extending upwardly at a certain inclined degree therefrom.

Figure 3:
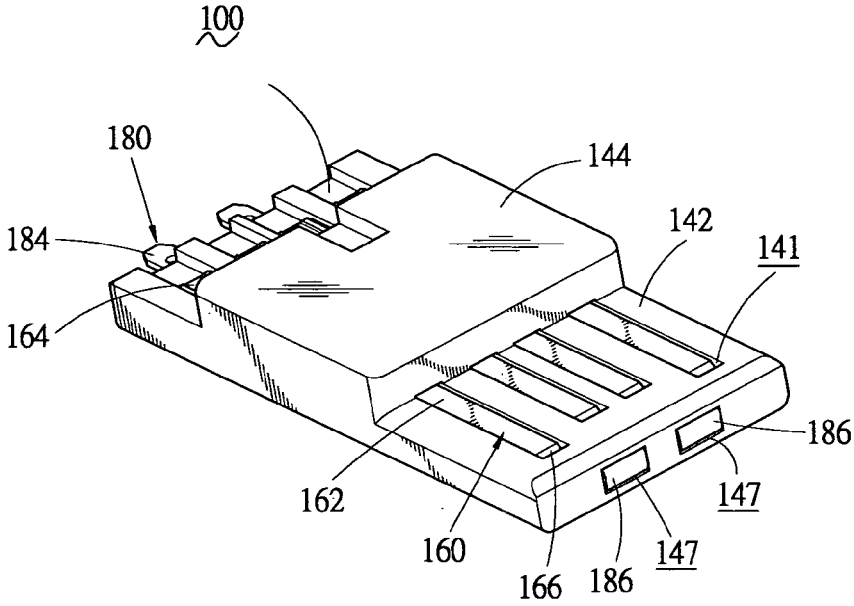
FIG. 3 is an assembled perspective view of the plug as shown in FIG. 1.
Figure 6:
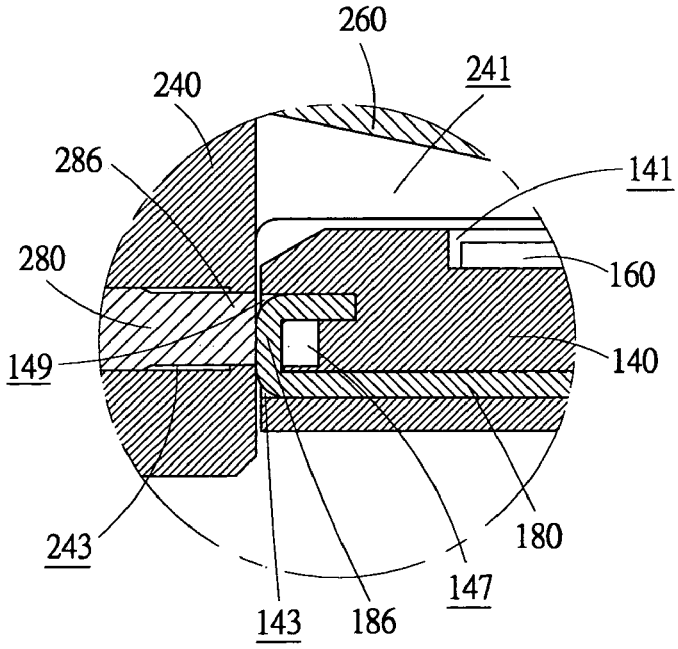
FIG. 6 is a partial enlarged view of FIG. 5.

Now referring to FIGS. 3, 5 and 6, as assembling, the first plug contacts 160 are received correspondingly in the first plug contact grooves 141, and the second plug contacts 180 are received correspondingly in the second plug contact grooves 143 respectively. The second soldering portions 184 of the second plug contacts 180 protrude outwards from the second plug contact grooves 143 respectively, and the second engaging portions 186 are received in the front contact groove 147 correspondingly. Meanwhile, the front holding portions 187 of the second plug contacts 180 are fixed correspondingly in the frond holding grooves 149, and the rear holding portions 185 of the second plug contacts 180 are held correspondingly in the rear holding grooves 145 with a free end of each rear holding portion 185 forcing forwardly an interior surface of the base body 142 respectively, so that the second plug contact 180 is capable of being fixed in the plug housing 140.

Figure 2:
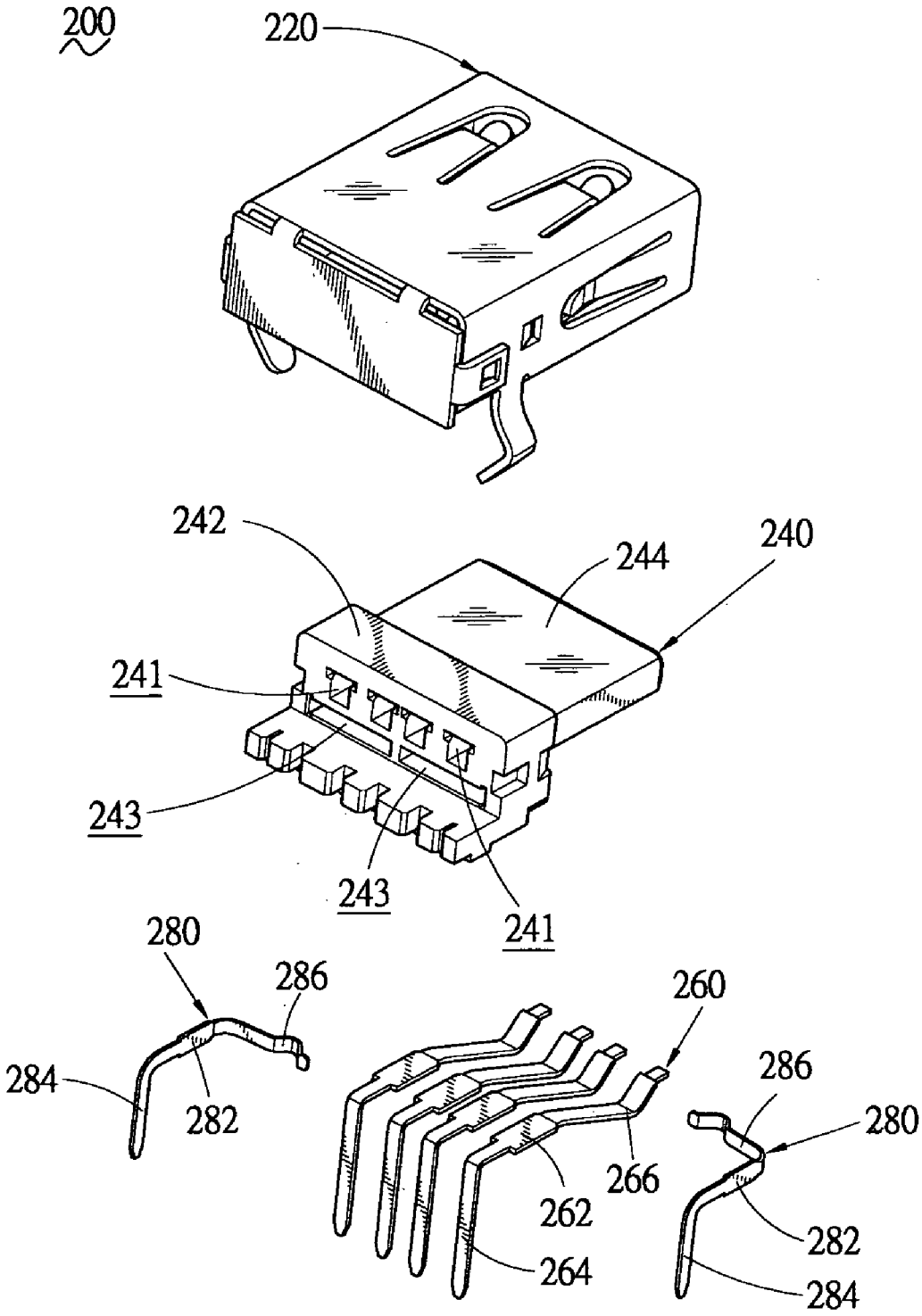
FIG. 2 is an exploded perspective view of a receptacle utilized in the connector assembly in accordance with the present invention.

With referring to FIG. 2, the receptacle 200 has a receptacle housing 240 enclosed within a receptacle shell 220. The receptacle housing 240 receives a plurality of first receptacle contacts 260 and second receptacle contacts 280 therein.

The receptacle housing 240 has a main body 242 with a cantilever body 244 extending forwardly from the main body 242. The main body 242 is lengthwise defined with a plurality of first receptacle contact grooves 241 and second receptacle contact grooves 243 paralleled with each other therein. Together with referring to FIG. 4, each first receptacle contact groove 241 passes through the interior of the main body 242 with the rear end thereof communicating with outside, and the front end extending forwardly to reach the front end of the cantilever body 244 along a lower surface of the cantilever body 244. The second receptacle contact grooves 243 are defined below the first receptacle contact grooves 241 and pass through the main body 242 with both end communicating with outside.

The first receptacle contacts 260 are also composed of a pair of juxtaposed long power contacts and a pair of juxtaposed short signal contacts. Each first receptacle contact 260 has a first main portion 262. The first main portion 262 is shaped with a first through-hole portion 264 extending downwardly therefrom and a first conductive portion 266 extending forwardly therefrom, wherein the first conductive portion 266 has a V-shape to provide an elastic conductive area in a lower surface thereof.

The second receptacle contacts 280 are also composed of a pair of juxtaposed signal contacts. Each second receptacle contact 280 has a second main portion 282. The second main portion 282 is formed with a second through-hole portion 284 extending downwardly from the rear end thereof and a second conductive portion 286 extending transversely from the front end thereof, wherein the pair of second conductive portions 286 are arranged opposite to each other and each has a curve conductive area extending forwardly therefrom.

Figure 4:
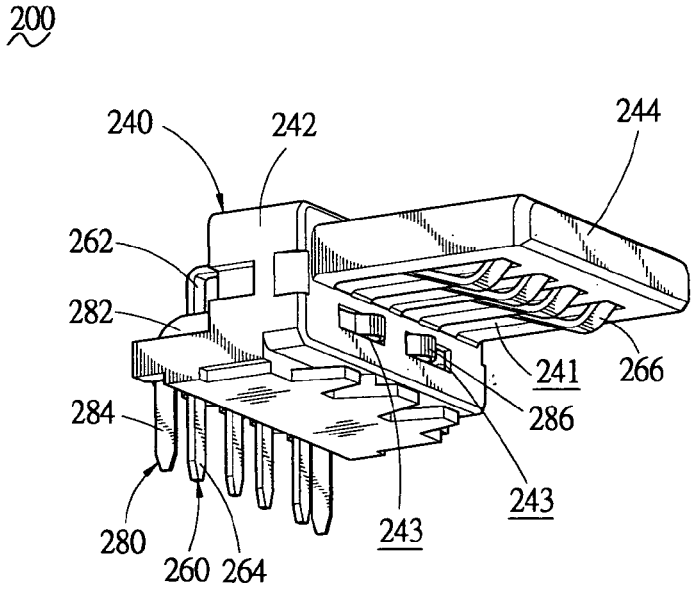
FIG. 4 is an assembled perspective view of the receptacle as shown in FIG. 2.

Now referring to FIGS. 4, 5 and 6, as assembling, the first receptacle contacts 260 are received correspondingly in the first receptacle contact grooves 241, and the second receptacle contacts 280 are received correspondingly in the second receptacle contact grooves 243 respectively. The first through-hole portions 264 and the second through-hole portions 284 parallel with each other and protrude outwardly and downwardly from the rear end of the main body 242. The first conductive portion 266 projects downwardly from the lower surface of the cantilever body 244, and the second conductive portion 286 projects forwardly from the front end of the main body 242, while the first conductive portion 266 is substantial perpendicular to the second conductive portion 286.

With referring to FIGS. 5, and 6, the plug 100 and the receptacle 200 mate with each other, and the base body 122 of the plug housing 120 inserts below the cantilever body 224 of the receptacle housing 220. Simultaneously, the first engaging portions 166 of the first plug contacts 160 connect electrically correspondingly with the first conductive portions 266 of the first receptacle contacts 260, and the second engaging portions 186 of the second plug contacts 180 connect electrically correspondingly with the second conductive portions 286 of the second receptacle contacts 280 respectively. Furthermore, the first soldering portions 164 of the first plug contacts 160 and the second soldering portions 184 of the second plug contacts 180 are all soldered with a cable (not shown), and the first through-hole portions 264 of the first receptacle contacts 260 and the second through-hole portions 284 of the second receptacle contacts 280 all connect electrically with a PCB. With this consequence, the cable and the PCB are connected electrically, further the power and at least two types of signals are capable of being transmitted therebetween. Therefore, the connector assembly 1 of the present invention is capable of providing a more powerful signal transmission function by means of a new design of the added second signal contacts as described above.

Although a particular embodiment of the invention has been described in detail for purposes of illustration, additional advantages and modifications will readily appear to those skilled in the art, and various modifications and enhancements may be made without departing from the spirit and scope of the invention. Accordingly, the invention is not to be limited except as by the appended claims.

What is claimed is:

1. A connector assembly comprising:

a plug including a plug housing enclosed within a plug shell, the plug housing having a base body with a protruding body extending upwardly from the substantial middle part of the base body, the base body being lengthwise defined with a plurality of first plug contact grooves on the top surface thereof, the first plug contact grooves passing through a lower surface of the protruding body and receiving a plurality of first plug contacts therein, the first plug contacts being composed of a pair of juxtaposed power contacts and a pair of juxtaposed signal contacts, each first plug contact having a first base portion, the first base portion being provided with a first soldering portion extending rearwards therefrom and a first engaging portion extending forwardly therefrom, the base body of the plug housing further being defined with a plurality of second plug contact apertures below the first plug contact grooves, the second plug contact apertures passing through the base body and receiving a plurality of second plug contacts therein, the second plug contacts being composed of a pair of juxtaposed signal contacts, each second plug contact having a second base portion, the second base portion being shaped with a second soldering portion extending rearwards therefrom and a second engaging portion extending upwardly therefrom, wherein the second engaging portion is formed with a front holding portion extending rearwards from a free end thereof for holding the second plug contact in the plug housing; and a receptacle having a receptacle housing enclosed within a receptacle shell, the receptacle housing having a main body with a cantilever body extending forwardly from the main body, the main body being lengthwise defined with a plurality of first receptacle contact grooves for receiving a plurality of first receptacle contacts therein, the first receptacle contact grooves passing through the main body and extending forwardly to reach a front end of the cantilever body along a lower surface of the cantilever body, the first receptacle contacts being also composed of a pair of juxtaposed power contacts and a pair of juxtaposed signal contacts, each first receptacle contact having a first main portion, the first main portion being shaped with a first through-hole portion extending downwardly therefrom and a first conductive portion extending forwardly therefrom, the main body of the receptacle housing further being lengthwise defined with a plurality of second receptacle contact grooves below the first receptacle grooves, the second receptacle contact grooves passing through the main body and receiving a plurality of second receptacle contacts therein, the second receptacle contacts being also composed of a pair of juxtaposed signal contacts, each second receptacle contact having a second main portion, the second main portion being formed with a second through-hole portion extending downwardly from the rear end thereof and a second conductive portion extending transversely from the front end thereof wherein the pair of second conductive portions are arranged opposite each other and each has a curve conductive area extending forwardly therefrom, whereby while the plug and the receptacle mate with each other, the base body of the plug housing inserts below the cantilever body of the receptacle housing, the first engaging portions of the first plug contacts connect electrically correspondingly with the first conducive portions of the first receptacle contacts, and the second engaging portions of the second plug contacts connect electrically correspondingly with the second conductive portions of the second receptacle contacts, the first and the second soldering portions are soldered with a cable, the first and the second through-hole portions connect electrically with a PCB, so the cable and the PCB are connected electrically, further the power and signal are capable of being transmitted therebetween.

2. The connector assembly as claimed in claim 1, wherein each of the second plug contact apertures substantial parallels with the corresponding first plug contact groove and is formed with a front contact groove extending upwardly a certain distance from the front end thereof for receiving the second engaging portion of the second plug contact therein, and further the front contact groove is formed with a front holding groove extending rearwards a certain distance therefrom and parallel with the second plug contact apertures for receiving the front holding portion of the second plug contact therein.

3. The connector assembly as claimed in claim 1, wherein approached the second soldering portion of each second plug contact, the second base portion is cut and bent to form a rear holding portion extending upwardly at a certain inclined degree therefrom and received in the second plug contact aperture whereby the second plug contact is capable of being fixed in the plug housing.

4. The connector assembly as claimed in claim 3, wherein each of the second plug contact apertures is further formed with a rear holding groove extending upwardly a certain distance from the rear end thereof, and the rear holding groove has a narrower width than the second plug contact groove and receives the rear holding portion of the second plug contact therein.

5. A plug for mating with a corresponding receptacle to form a connector assembly, the plug comprising:

a plug shell;

a plug housing enclosed within the plug shell, the plug housing having a base body with a protruding body extending upwardly from the substantial middle part of the base body, the base body being lengthwise defined with a plurality of first plug contact grooves on the top surface thereof, the first plug contact grooves passing through a lower surface of the protruding body, the base body further being defined with a plurality of second plug contact apertures therein, the second plug contact apertures being defined below the first plug contact grooves and passing through the base body;

a plurality of first plug contacts being composed of a pair of juxtaposed power contacts and a pair of juxtaposed signal contacts and received in the first plug contact grooves correspondingly, each first plug contact having a first base portion, the first base portion being provided with a first soldering portion extending rearwards therefrom for being soldered with a cable and a first engaging portion extending forwardly therefrom for connecting electrically with the receptacle;

a plurality of second plug contacts being composed of a pair of juxtaposed signal contacts and received in the second plug contact apertures correspondingly, each second plug contact having a second base portion, the second base portion being shaped with a second soldering portion extending rearwards therefrom for soldered with the cable and a second engaging portion extending upwardly therefrom for connecting electrically with the receptacle, further the second engaging portion being formed with a front holding portion extending rearwards from a free end thereof for holding the second plug contact in the plug housing.

6. The plug as claimed in claim 5, wherein each of the second plug contact apertures substantial parallels with the corresponding first plug contact groove and is formed with a front contact groove extending upwardly a certain distance from the front end thereof for receiving the second engaging portion of the second plug contact therein, and further the front contact groove is formed with a front holding groove extending rearwards a certain distance therefrom and parallel with the second plug contact aperture for receiving the front holding portion of the second plug contact therein.

7. The plug as claimed in claim 5, wherein approached the second soldering portion of each second plug contact, the second base portion is cut and bent to form a rear holding portion extending upwardly at a certain inclined degree therefrom and received in the second plug contact aperture whereby the second plug contact is capable of being fixed in the plug housing.

8. The plug as claimed in claim 7, wherein each of the second plug contact apertures is further formed with a rear holding groove extending upwardly a certain distance from the rear end thereof, and the rear holding groove has a narrower width than the second plug contact aperture and receives the rear holding portion of the second plug contact therein.

* * * * *